US010992089B1

(12) United States Patent
Büyükay

(10) Patent No.: US 10,992,089 B1
(45) Date of Patent: Apr. 27, 2021

(54) SAFETY SOCKET OUTLET

(71) Applicant: Sinan Büyükay, Solingen (DE)

(72) Inventor: Sinan Büyükay, Solingen (DE)

( * ) Notice: Subject to any disclaimer, the term of this patent is extended or adjusted under 35 U.S.C. 154(b) by 0 days.

(21) Appl. No.: 16/699,199

(22) Filed: Nov. 29, 2019

(51) Int. Cl.

| | |
|---|---|
| ***H01R 13/52*** | (2006.01) |
| ***H01R 24/78*** | (2011.01) |
| ***H01R 13/713*** | (2006.01) |
| ***H01R 13/04*** | (2006.01) |
| ***H01R 13/447*** | (2006.01) |

(52) U.S. Cl.
CPC ..... *H01R 24/78* (2013.01); *H01R 13/04* (2013.01); *H01R 13/447* (2013.01); *H01R 13/713* (2013.01)

(58) Field of Classification Search
CPC ..... H01R 13/5219; H01R 13/5202; H01R 13/52; H01R 13/5221; H01R 13/5205; H01R 13/5208; H01R 4/2404; H01R 4/26
USPC ..... 439/271–275, 426
See application file for complete search history.

(56) References Cited

U.S. PATENT DOCUMENTS

| | | | | |
|---|---|---|---|---|
| 10,148,033 | B2 * | 12/2018 | Mortun | H02G 3/18 |
| 2003/0045145 | A1 * | 3/2003 | Mortun | H01R 13/703 439/145 |
| 2004/0203270 | A1 * | 10/2004 | Wang | H01R 13/4534 439/136 |

* cited by examiner

*Primary Examiner* — Phuong Chi Thi Nguyen
(74) *Attorney, Agent, or Firm* — Collard & Roe, P.C.

(57) ABSTRACT

Multiple socket with a housing, a power supply component and connections for safety plugs, wherein connections and safety plugs are dimensionally matched to one another with at least one flexible cover for the connections providing access for the contact pins of safety plugs, wherein the accesses are designed in the form of slots expanding when the contact pins of a safety plug are inserted, a cover plate, which is arranged underneath and connected to the cover(s) and has apertures for the contact pins of a safety plug, an insert arranged in the housing for a current conductor, a neutral conductor and a ground conductor, with the contacts of the current conductor, the neutral conductor and the ground conductor each being connected to one another via rails, arranged in separate brackets and accessible for the contact pins of a safety plug through the flexible cover and the cover plate, and an on/off switch connected to the power conductor.

16 Claims, 7 Drawing Sheets

SAFETY SOCKET OUTLET

Figure 1:
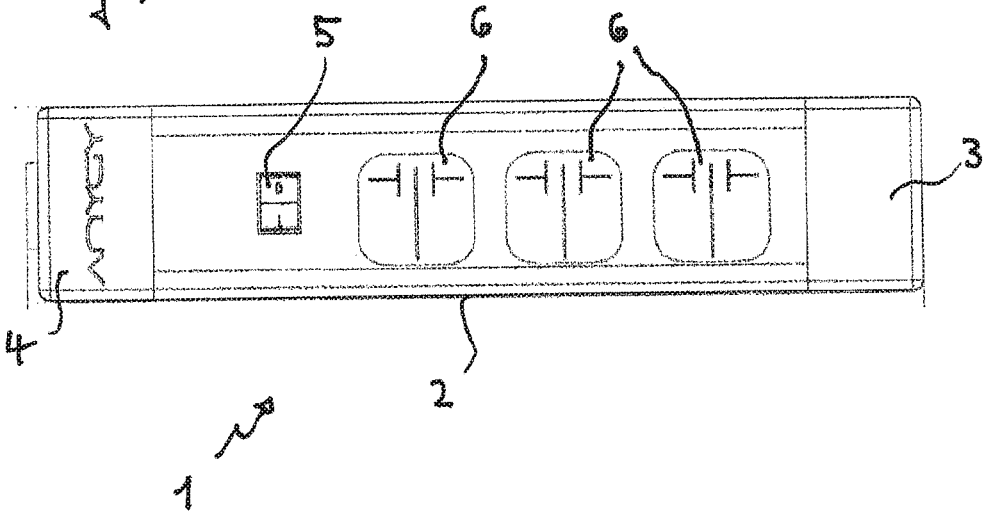

The invention relates to a multiple socket with two or more connections for safety plugs, with the respective connections and safety plugs being dimensionally matched to each other. In particular, said safety socket outlet is a multiple socket power strip intended for mobile use.

Safety sockets have been known for decades and in numerous variants, with such variants usually being designed and standardized to suit country-specific requirements. In the USA, the NEMA system is commonly in use, in which the safety socket on the one hand and the safety plug on the other are dimensionally matched to each other, the current conductor and the neutral conductor are arranged under a cover plate and ground contacts are arranged on the periphery of the connection for safety reasons. These safety sockets have generally proved their worth, but there is a risk when young children—mostly driven by curiosity—are concerned with them and explore how they work. To counteract risks of this nature, safety mechanisms have been developed, ranging from a complete blocking of the socket to the installation of a child safety device. For the purpose of blocking the socket, a "pseudo plug" is to be inserted, which is difficult to remove when the socket is needed. A child safety device usually requires a glued-in protective plate to be turned or rotated in order to align the openings in the safety element of the protective plate with the insertion holes of the socket, which is a laborious and time-consuming task especially with sockets mounted close to the floor area. Removing the protective plate is difficult.

The same applies to multiple sockets and mobile multiple sockets such as socket strips.

It is the objective of the present invention to provide a safety socket, also for multiple sockets and socket strips, which has a built-in child protection system that cannot be easily circumvented even by "tinkering" young children, with said system being manufactured and operated simply and easily.

This objective is achieved by providing a multiple socket of the kind first mentioned above, with said socket comprising

- at least one flexible cover for the connections with accesses for the contact pins of safety plugs, wherein the accesses are provided in the form of slots which expand when the contact pins of a safety plug are inserted,
- a cover plate which is arranged underneath and connected to the cover or covers, with apertures for the contact pins of a safety plug being provided in said cover plate,
- an insert arranged in the housing for a current conductor, a neutral conductor and a ground conductor, wherein the contacts of the current conductor, the neutral conductor and the ground conductor each being connected with one another via rails, being arranged in separate retaining elements and being accessible for the contact pins of a safety plug through the flexible cover and cover plate, and
- an on/off switch connected to the power conductor.

The multiple socket proposed by the invention is equipped with the usual elements, namely a power supply, an on/off switch and connection points for several safety plugs. These elements are arranged in a housing which may be made of a resistant plastic material or metal. In particular, the housing consists of a central, trough-shaped part and two head ends, one of which containing the power supply components. Preferably, the number of connections is three, six or eight.

To make access to the connection points for the safety plugs more difficult for children, the multiple sockets have at least one flexible cover for the connections which allow access for the contact pins of safety plugs, said accesses being designed in the form of slots that expand and give way when the contact pins of a safety plug are inserted. For this purpose, the cover consists of flexible plastic material, for example of soft PVC, which has the necessary resilience and thus is capable of resuming its original shape even after multiple deformation.

The slots in the cover are preferably incisions that allow the insertion of the contact pins of a customary NEMA plug. For example, the slots are T-shaped. It goes without saying that the distances between the slots correspond to the distances between the contact pins of a NEMA plug.

All connections of a multiple socket proposed by the invention are of course protected by a cover; however, said cover may be provided for each individual connection or a common cover may be provided for all the connections.

At least one flexible cover means that either each individual connection is fitted with such a cover or a single cover protecting all connections at the same time is provided. The former variant is advantageously used for multiple sockets having two or three connections only, while the latter is recommended for sockets with four or more connections.

Underneath the cover or covers a cover plate is arranged which is attached to said cover or covers. For this purpose, pins are arranged on the underside of the covers which snap into corresponding apertures existing in the cover plate. The snap-in or latching connections should be strong enough that they cannot be released by children.

Inside the housing and underneath the cover plate there is an insert in which the electrical components are arranged. Said components are the current conductor, the neutral conductor and the ground conductor. The individual contact sleeves of the conductors are expediently connected by means of rails and mounted in separate brackets. The brackets and contact sleeves are arranged such that they are accessible for the contact pins of a customary safety plug inserted through the cover and the cover plate. Cover plate and insert are firmly connected to each other, e.g. by snap-in plugs.

The inventive multiple socket outlet is preferably provided with an on/off switch, which is expediently located on the top of the housing.

The rails of the current conductor and the neutral conductor on the one hand and of the ground conductor on the other hand extend for safety reasons on opposite longitudinal sides within the insert. With a view to avoiding short circuits, the rails of the current conductor and neutral conductor are reliably separated from each other by means of pins or walls attached to the cover plate or insert.

In accordance with a preferred embodiment, the multiple socket proposed by the invention has aside from the cover plate a lower retaining element for the insert. In this embodiment, the cover plate serves as upper retaining element. In this variant, both the upper and lower retaining elements are provided with projections pointing into the interior of the housing, between which the insert is firmly mounted.

The insert in this embodiment can be divided into an upper and a lower space by a horizontally extending subdivision or wall, with the ground conductor being arranged in the upper space and the current conductor and neutral conductor in the lower space. The upper as well as the lower space are provided with the necessary brackets for the contact sleeves. There are apertures in the subdivision or wall allowing the contact pins of the safety plug to be inserted.

In the area of the apertures in the insert through which the contact pins of the current or neutral conductor are passing, a coil spring can be arranged as a positioning aid, which puts the respective contact pin under pressure to compensate for dimensional variations in the contact pin thickness and to ensure the pin is firmly seated in the respective connection point.

Figure 2:
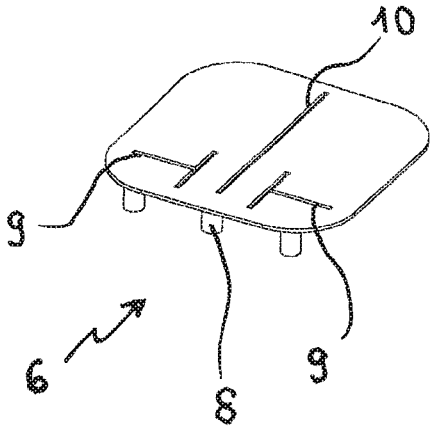
Figure 3:
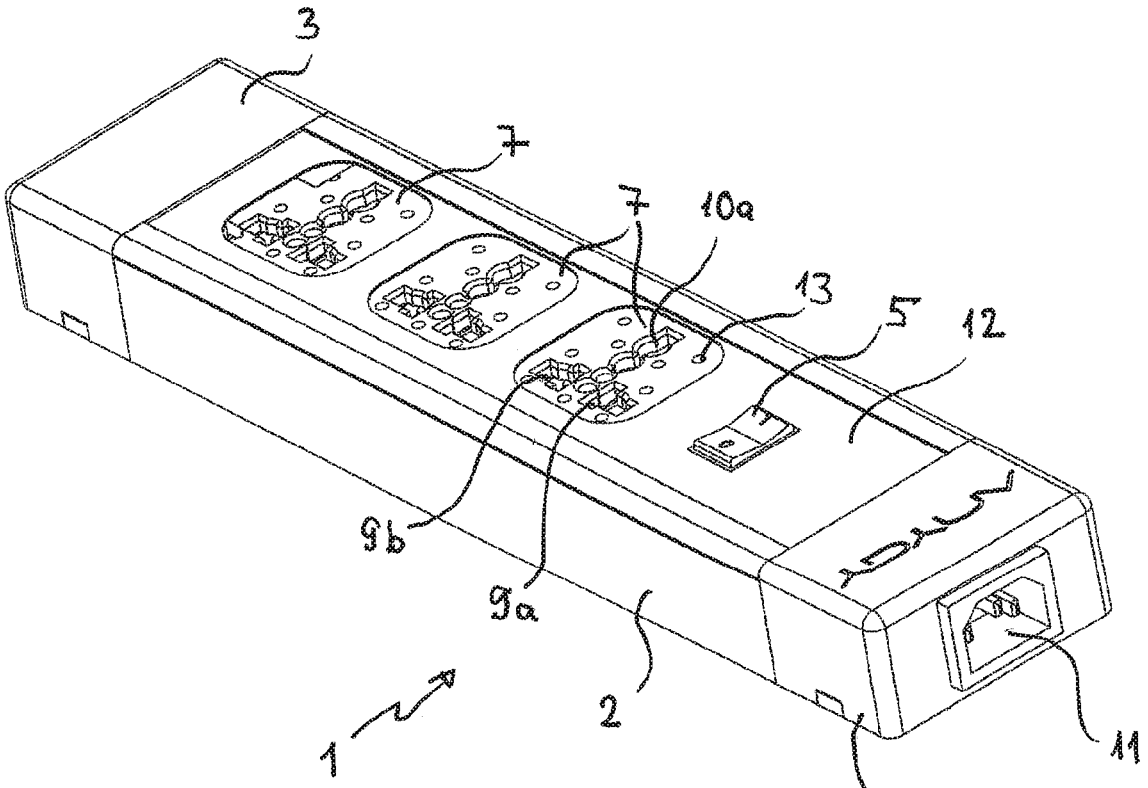
Figure 4:
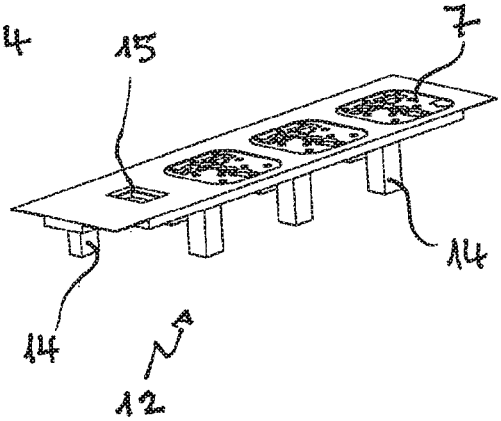
Figure 5:
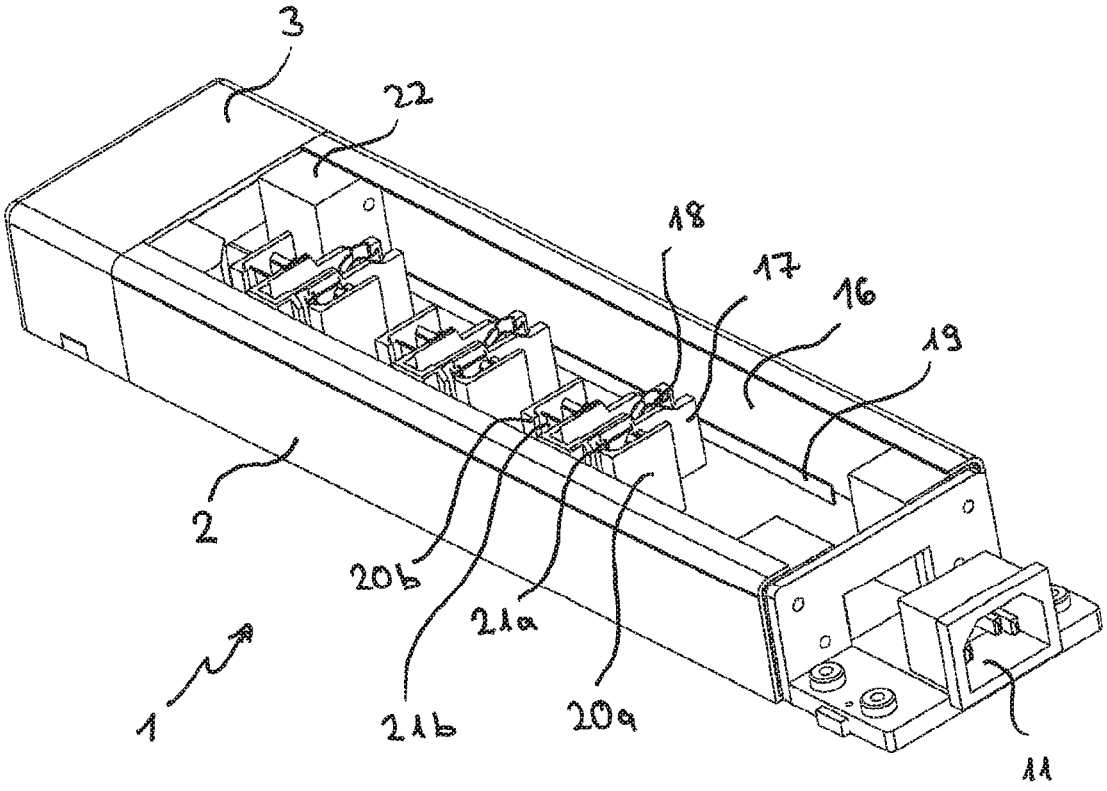
Figure 6:
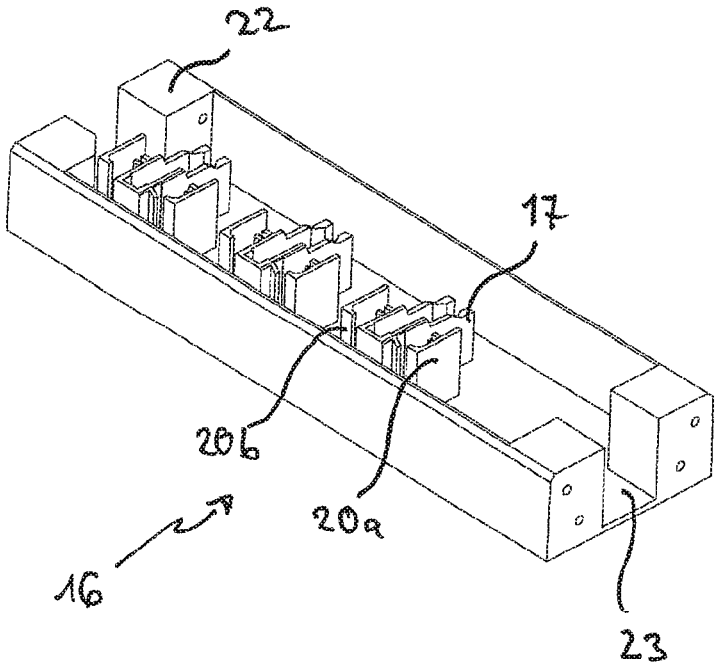
Figure 7:
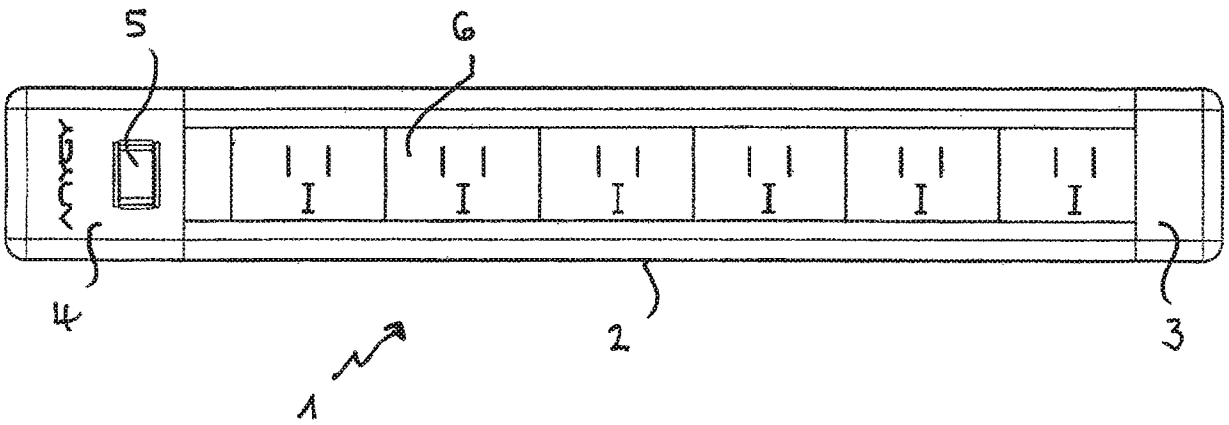
Figure 8:
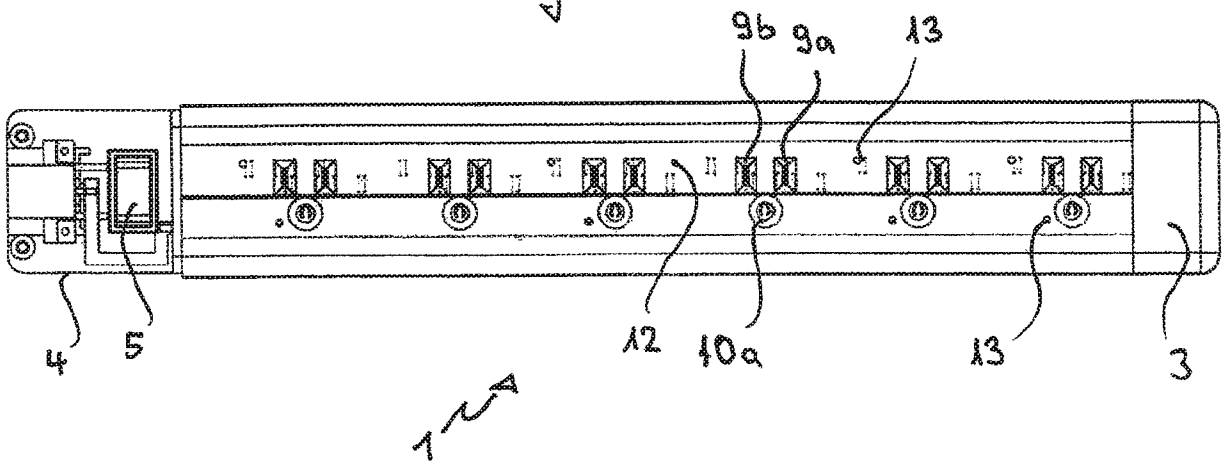
Figure 9:
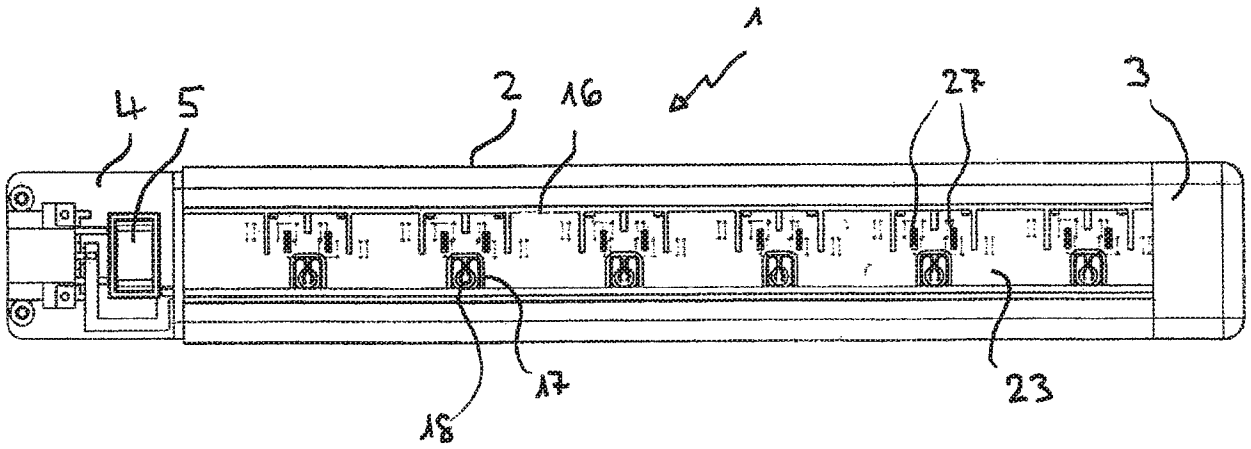
Figure 10:
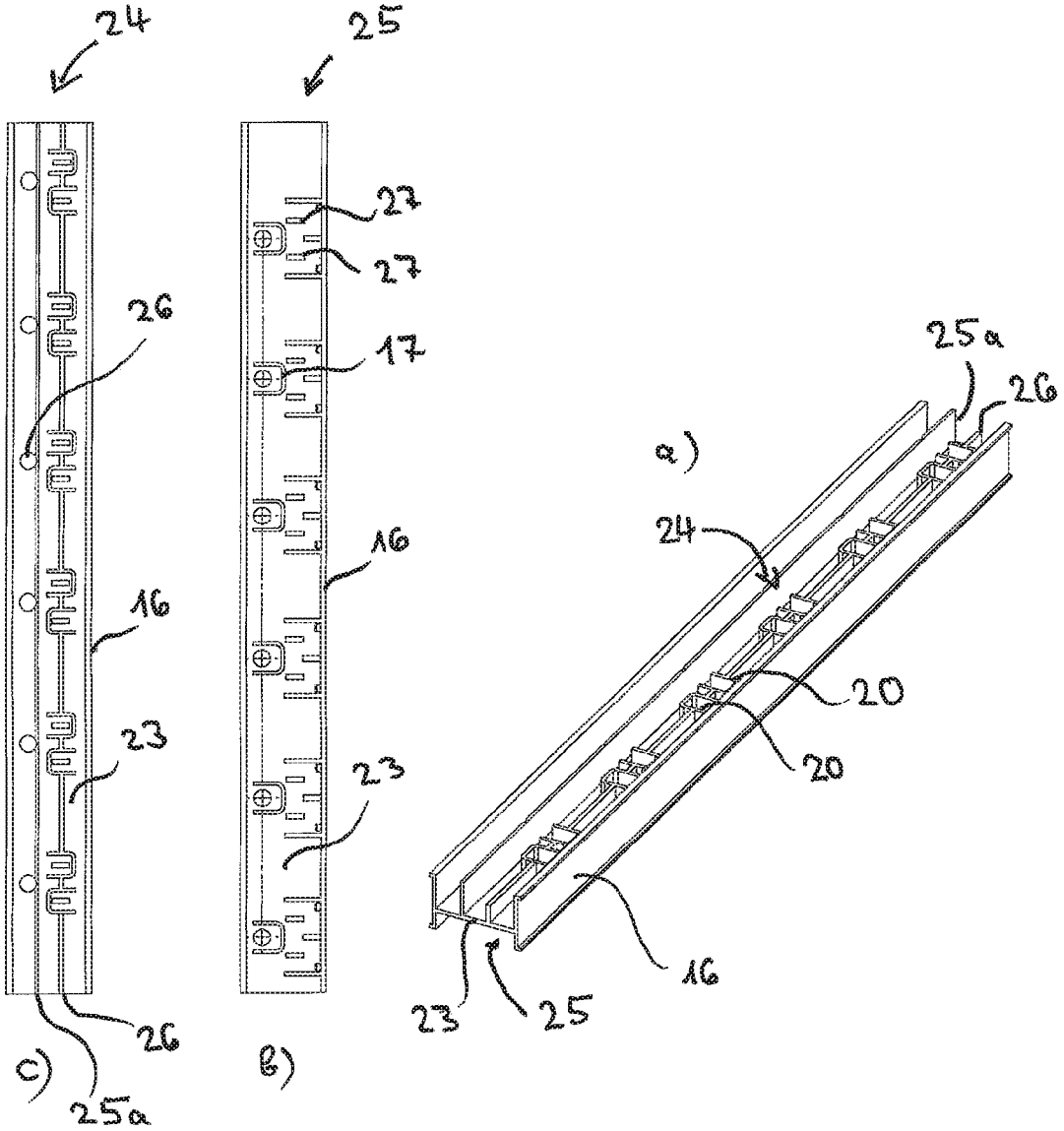

The invention is explained in more detail by way of the enclosed figures. It has to be understood that the representations are preferred embodiments, the individual features of which can be combined with each other in any conceivable way; said representations show in FIG. 1 a general view of a triple socket seen from above;

FIG. 2 a cover for one connection point of the triple socket shown in FIG. 1;

FIG. 3 the triple socket of FIG. 1 in perspective view with the covers being removed;

FIG. 4 the cover plate of the triple socket shown in FIG. 1;

FIG. 5 the triple socket of FIG. 3 after removal of the cover plate;

FIG. 6 the insert of the triple socket shown in FIG. 3;

FIG. 7 another embodiment of a multiple socket with six connection points;

FIG. 8 the multiple socket shown in FIG. 7 with the cover being removed;

FIG. 9 the multiple socket shown in FIG. 8 without the cover plate;

FIG. 10 the insert of the multiple sockets as per FIGS. 7 to 9; and

Figure 11:
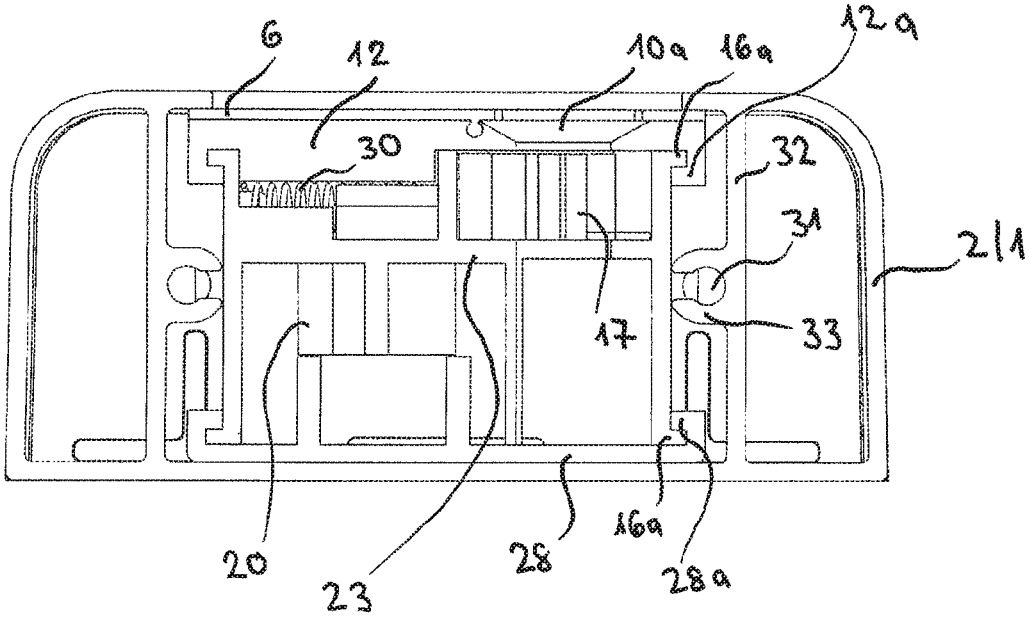

FIG. 11 a cross-section through another variant of a multiple socket.

FIG. 1 illustrates in top view a multiple socket outlet according to the invention with housing 1 which consists of trough 2 and the two head ends 3 and 4. The head end 4 also comprises the contact pins for the electrical connection by means of a coupling piece. An on/off switch 5 is located on the top side of the multiple socket 1, three connections for safety plugs are closed off by means of covers 6.

Shown in FIG. 2 is a perspective representation of a cover 6. The cover has the shape of a customary connection and is provided with latch pins 8 arranged on the underside for attachment to a cover plate underneath (not shown). Cover 6 consists of a soft, reversibly deformable plastic material, for example soft PVC, and has T-shaped incisions 9 and a further incision 10 that extends between these incisions 9. Incisions 9 are intended for the entry of the contact pins of the current conductor and neutral conductor, while incision 10, which extends between the incisions 9 over about ¾ of the diameter of the cover 6, is to accommodate the contact pin of the ground conductor.

FIG. 3 shows an inventive triple socket 1 with the covers being removed from the three connections 7.

The electrical power connection 11 with contact pins is located in the head end 4, the on/off switch 5 is arranged on the cover plate 12. The three connections 7 are spaced at regular intervals on the cover plate 12 and are provided with apertures 9*a* and 9*b* for the contact pins of the current conductor and the neutral conductor of a safety plug. Access for the ground conductor is via aperture 10*a*. Latching holes 13 in the connection areas serve for snap-in attachment of the connections 7 to the covers 6.

In FIG. 4 the cover plate 12 is shown in perspective view comprising supports 14 arranged on the plate underside, the opening 15 for the on/off switch and the three connections 7. Supports 14 serve to prop up the cover plate on the bottom of an insert located underneath provided with the individual electrical connections and for the separation as well as fixation of the conductor rails which carry the contact sleeves for the contact pins.

FIG. 5 shows the multiple sockets according to FIG. 3 with cover plate 12 being removed. Inside the trough 2 of the housing 1 an insert 16 is arranged, which carries the brackets 17 for the contact sleeves 18 of the ground conductor contact pins and 20 for the contact sleeves 21*a* and 21*b* of the contact pins of the current conductor and the neutral conductor. The brackets 17 and 20 are permanently attached to the insert 16. A rail 19 connects the contact sleeves 18 for the contact pins of the ground conductor.

It can also be seen that housing 1 is provided with head end 3, and details of head end 4 comprising the contacts for the power supply 11 have also been illustrated. Corner elements 22 serve as abutment of the cover plate 12, which is also held up by the supports 14. The head ends 3 and 4 are firmly latched to the insert 16 via pins in such a way that housing 1 forms an integral unit with the insert 16.

FIG. 6 shows the insert 16 comprising corner elements 22, brackets 17 and 20 as well as opening 23 for the power supply components. The insert consists of a non-conductive, rigid plastic material. Naturally, the insert 16 is firmly attached in the housing 1 and the cover plate 12 is firmly connected to the insert 16. The insert 16 is fixed in the trough by means of the head ends 3 and 4.

In FIG. 7 another embodiment of an inventive multiple socket 1 is illustrated comprising a total of six connection options for safety plugs, said connections being covered by a uniform cover 6. For each connection point, cover 6 has been provided with the incisions for the relevant safety plug contact elements. In addition, the housing 1 consists of the trough 2 and the head ends 3 and 4, the latter of which carries the on/off switch 5 and is equipped with the power supply components.

FIG. 8 shows the multiple socket depicted in FIG. 7 after removal of cover 6 with power supply components including on/off switch 5 being exposed. The exposed cover plate 12 shows the apertures 9*a*, 9*b*, 10*a* for the plug-in contacts. Latch openings 13 serve to connect the cover 6 with the cover plate 12.

FIG. 9 shows the multiple socket illustrated in FIG. 7 with insert 16 being exposed. On the subdivision or wall 23 there are the brackets 17 for the contact sleeves 18 of the ground conductor as well as the apertures 27 for the contact pins of the current conductor and the neutral conductor. Underneath the contact sleeves 18 there are apertures which allow the contact pins of the ground conductor to reach into the area below the wall 16.

FIG. 10 shows the insert 16 of the multiple socket as per FIG. 7 in perspective from the underside (FIG. 10*a*) as well as in top view from below (FIG. 10*c*) and from above (FIG. 10*b*).

Insert 16 is divided by a wall or subdivision 23 into a lower space 24 and an upper space 25. The lower space 24 also contains a partition 25 and a subdivision 26, the latter separating the rails of the current conductor and the neutral conductor from each other. Brackets 20 arranged in the area of the subdivision 26 are accommodating the contact sleeves of the current conductor and the neutral conductor. Wall 25 separates the contact pins of the ground conductor from the current-carrying area.

FIG. 11 shows a cross section of another variant of the multiple sockets according to FIG. 7 with the housing 1, the insert 16, the cover 6 on the upper side of a cover plate 12 which at the same time serves as an upper retaining element for the insert 16 and for this reason has one of the supporting projections 12*a* which interact with outwardly protruding projections 16*a*, and a lower retaining element 28 which, same as the upper retaining element 12, is suitable for fixing the insert 16 via projections 28*a* and 16*a*. The aperture 10*a* serves to accommodate the contact pin of a ground conductor, the spring 30 serves to guide and fix the contact pins of the current or neutral conductors. In the figure, subdivision 23 of the insert 16 can be seen, which carries the brackets 17 and 20 of the contact pins. Insert 16 is additionally secured by rails 31 with guides 33 of walls 32 of housing 1.

The top view of FIG. 10*c* shows the apertures 26 through which the contact pins of the ground conductor protrude into the lower space 25. The brackets 17 for the contact sleeves of the ground conductor are located in the upper space 25, as are the apertures 27 for the contact pins of the current conductor and the neutral conductor.

The invention claimed is:

1. A multiple socket comprising a housing, a power supply component and connections for safety plugs, with the respective connections and safety plugs being dimensionally matched to each other, with the socket comprising at least one flexible cover for the connections with accesses for the contact pins of safety plugs, wherein the accesses are provided in the form of slots which expand when the contact pins of a safety plug are inserted, a cover plate which is arranged underneath and connected to the cover or covers, with apertures for the contact pins of a safety plug being provided in said cover plate, an insert arranged in the housing for a current conductor, a neutral conductor and a ground conductor, wherein the contacts of the current conductor, the neutral conductor and the ground conductor each being connected with one another via rails, being arranged in separate retaining elements and being accessible for the contact pins of a safety plug through the flexible cover and the cover plate, and an on/off switch connected to the power conductor;

wherein the cover plate is designed so as to form the upper retaining element for the insert, with a lower retaining element being arranged at the bottom of the housing.

2. The multiple socket according to claim 1, wherein each of the connections is provided with a flexible cover or all the connections together have a flexible cover.

3. The multiple socket according to claim 1, wherein the slots for the contact pins of the current and neutral conductors are designed so as to have a T-shape.

4. The multiple socket according to claim 1, wherein the at least one cover comprises flexible plastic material having resilience/resetting capability.

5. The multiple socket according to claim 1, wherein the cover plate and the at least one cover are latched together via pins.

6. The multiple socket according to claim 1, wherein the housing comprises a central trough and two head ends, with the power connection being arranged in one of these head ends.

7. The multiple socket according to claim 1, wherein the on/off switch is arranged on the cover plate.

8. The multiple socket according to claim 1, wherein the on/off switch is arranged at a head end of the housing in the area of the power supply device.

9. The multiple socket according to claim 1, wherein the rails of the current conductor and of the neutral conductor on the one hand and of the ground conductor on the other hand are arranged on opposite longitudinal sides of the insert.

10. The multiple socket according to claim 9, wherein the rails of the current conductor and the neutral conductor are separated from each other by pins arranged on the under-side of the cover plate.

11. The multiple socket according to claim 1, wherein the insert is divided into an upper and a lower space by a subdivision.

12. The multiple socket according to claim 11, wherein the rail of the ground conductor is located in the upper space, while the rails of the current conductor and the neutral conductor are arranged in the lower space.

13. The multiple socket according to claim 11, wherein apertures are provided in the subdivision of the insert for the contact pins of safety plugs.

14. The multiple socket according to claim 13, wherein brackets for the contacts of the current conductor and the neutral conductor are arranged on the underside of the subdivision.

15. The multiple socket according to claim 14, wherein brackets for the contacts of the ground conductor are arranged on the upper side of the subdivision.

16. The multiple socket according to claim 14, wherein a spring element is arranged on the upper side of the subdivision adjacent to the aperture for the contact pin of the current conductor or neutral conductor of the safety plug.

* * * * *